US009581932B2

(12) United States Patent
Makino

(10) Patent No.: US 9,581,932 B2
(45) Date of Patent: Feb. 28, 2017

(54) DEVELOPING APPARATUS AND IMAGE FORMING APPARATUS

(71) Applicant: CANON FINETECH INC., Misato-shi, Saitama-ken (JP)

(72) Inventor: Yusaku Makino, Noda (JP)

(73) Assignee: CANON FINETECH INC., Misato-shi (JP)

( * ) Notice: Subject to any disclaimer, the term of this patent is extended or adjusted under 35 U.S.C. 154(b) by 0 days.

(21) Appl. No.: 14/541,181

(22) Filed: Nov. 14, 2014

(65) Prior Publication Data

US 2015/0160583 A1 Jun. 11, 2015

(30) Foreign Application Priority Data

Dec. 5, 2013 (JP) ..... 2013-251801
Dec. 5, 2013 (JP) ..... 2013-251802

(51) Int. Cl.
*G03G 15/08* (2006.01)

(52) U.S. Cl.
CPC ..... *G03G 15/0812* (2013.01)

(58) Field of Classification Search
CPC ..... G03G 15/0812
USPC ..... 399/284
See application file for complete search history.

(56) References Cited

U.S. PATENT DOCUMENTS 4,566,402 A 1/1986 Shimazaki
4,579,081 A * 4/1986 Kohyama ..... 399/119
5,073,797 A 12/1991 Ono et al.
8,712,296 B2 4/2014 Mori
2009/0142108 A1 6/2009 Blanck et al.
2012/0082476 A1 4/2012 Ito et al.
2014/0212183 A1 7/2014 Mori

FOREIGN PATENT DOCUMENTS

JP S60-122969 U 8/1985
JP S63-155068 A 6/1988
JP H04-125677 A 4/1992
JP H06-3938 A 1/1994
JP H06-27799 A 2/1994
JP H09-319179 A 12/1997
JP 2001-331034 A 11/2001
JP 2003-076140 A 3/2003
JP 2011-150269 A 8/2011

OTHER PUBLICATIONS

Japanese Office Action dated Nov. 29, 2016, in related Japanese Patent Application No. 2013-251802 (with English translation).
Japanese Office Action dated Dec. 20, 2016, in related Japanese Patent Application No. 2013-251801 (with English translation).

* cited by examiner

*Primary Examiner* — Hoang Ngo
(74) *Attorney, Agent, or Firm* — Fitzpatrick, Cella, Harper & Scinto

(57) ABSTRACT

A developing apparatus includes a developer carrying member configured to carry developer, a blade configured to be deformed by contacting the developer carrying member, and an operation member provided on an opposite side to a side of the blade contacting the developer carrying member. The operation member is configured to contact the deformed blade so as to cause the blade to act on the developer carrying member at a predetermined pressure.

9 Claims, 5 Drawing Sheets

DEVELOPING APPARATUS AND IMAGE FORMING APPARATUS

BACKGROUND OF THE INVENTION

Field of the Invention

The present invention relates to a developing apparatus to be used in an image forming apparatus such as a copying machine, a printer, and a facsimile machine, and more particularly, to a configuration of a blade configured to contact a developer carrying member in a developing container.

Description of the Related Art

In a developing container of an image forming apparatus configured to form images with developer, there is provided a developing blade configured to regulate an amount of the developer so that the developer carried on a surface of a developing sleeve has a uniform constant thickness. The developing blade contacts the developing sleeve, and is formed of an elastic member in many cases. Further, in order to generate a predetermined pressure, the developing blade is arranged in a manner that an opposite surface of the developing blade to a surface of the developing blade contacting the developing sleeve is in contact with a pressing member such as a thin plate member.

The developing blade is mounted to the developing container by a holding member (Japanese Patent Application Laid-Open No. 2011-150269).

However, at a contact portion between the developing blade and the developing sleeve, in a case where the developing blade and the developing sleeve do not uniformly contact each other in a longitudinal direction of the developing blade, the developer on the surface of the developing sleeve cannot be made uniform in thickness. As a result, images of output printed materials are adversely affected. Thus, the developing blade and the developing sleeve need to contact each other without a gap at a uniform pressure in the longitudinal direction. However, the developing blade is formed of an elastic member, and hence has a micro distortion in itself. The micro distortion forms a gap in the contact portion.

It may be conceived to employ a method of increasing contact pressure to be applied between the developing blade and the developing sleeve so that the gap is closed. However, the method shortens a lifetime of the developing blade. As a result, a replacement cycle of the developing container is shortened, which results also in a cost increase.

SUMMARY OF THE INVENTION

The present invention has been made to solve the above-mentioned problems. The present invention provides a developing apparatus which allows a developing blade and a developing sleeve to contact each other at a uniform pressure without influence of distortion of the developing blade, and provides an image forming apparatus including the developing apparatus.

According to an embodiment of the present invention, there is provided a developing apparatus, comprising: a developer carrying member configured to carry developer; a blade configured to be deformed by contacting the developer carrying member; and an operation member provided on an opposite side to a side of the blade contacting the developer carrying member, the operation member being configured to contact the blade, which is deformed, so as to cause the blade to act on the developer carrying member at a predetermined pressure.

Further features of the present invention will become apparent from the following description of exemplary embodiments with reference to the accompanying drawings.

DESCRIPTION OF THE EMBODIMENT

Now, an embodiment of the present invention will be described in detail with reference to the accompanying drawings.

(Overall Configuration of Copying Machine)

Figure 1:
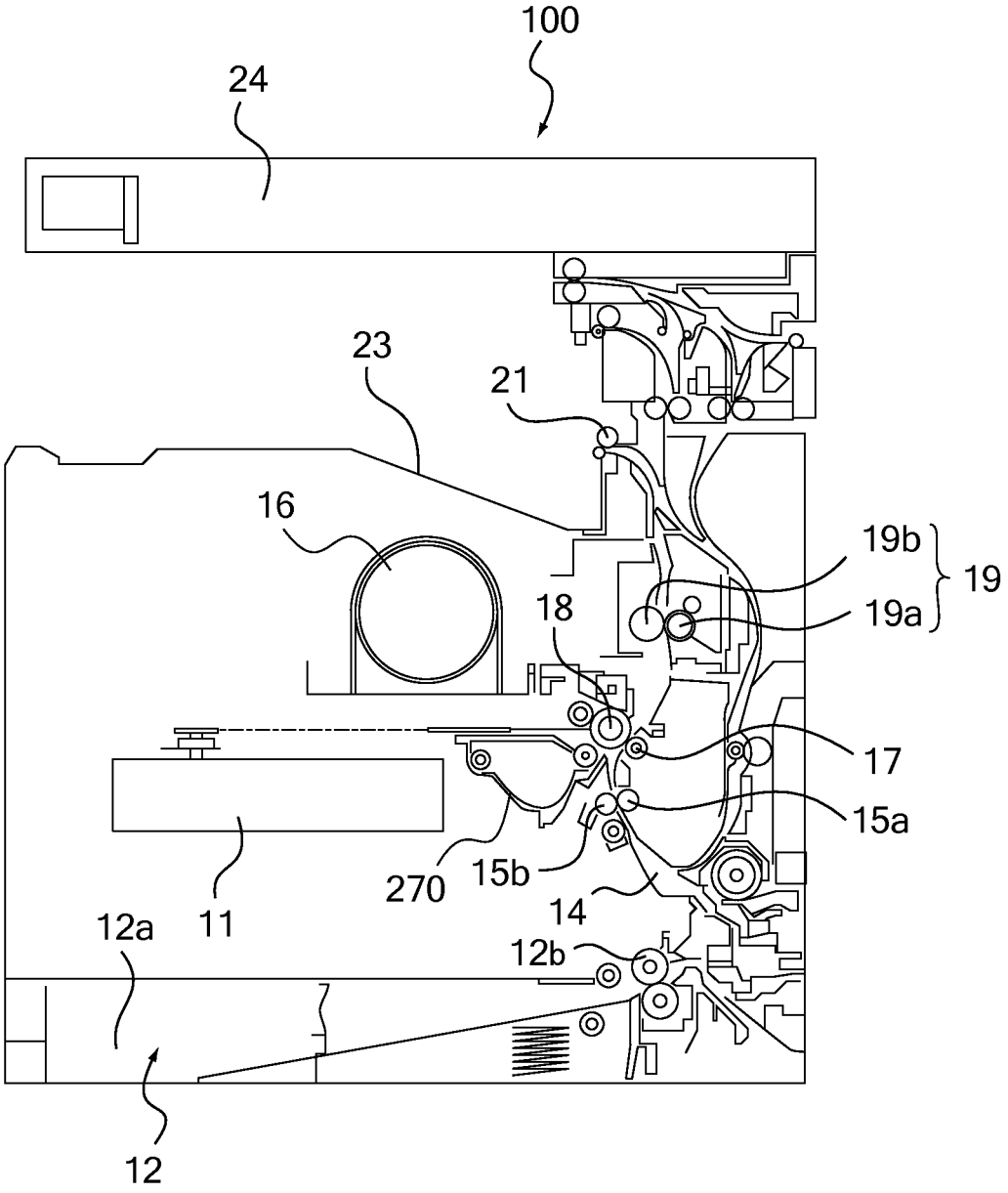
FIG. 1 is a schematic front view of an image forming apparatus according to an embodiment of the present invention.

FIG. 1 is a schematic front view of a copying machine serving as an image forming apparatus according to an embodiment of the present invention.

In an image forming apparatus 100 illustrated in FIG. 1, image information transmitted from, for example, external computers and image information of images read by an original reading portion 24 are converted to light modulation information by a laser beam emitting-writing unit 11, and then emitted as a laser beam. The laser beam emitted from the laser beam emitting-writing unit 11 is formed into a spot image on a rotating photosensitive drum 18. The laser beam radiated onto the photosensitive drum 18 is reciprocally scanned so that an electrostatic latent image corresponding to the image information is formed on the photosensitive drum 18. Then, toner is supplied from a developing apparatus 270 onto the electrostatic latent image on the photosensitive drum 18. In this way, an unfixed toner image is formed.

Meanwhile, in a lower portion of the image forming apparatus 100, there is arranged a feed unit 12 configured to feed a recording medium such as a sheet of paper. A stacking cassette portion 12*a* provided in the feed unit 12 is configured to store the recording media in a stacked manner. Then, a feed roller 12*b* feeds the recording medium.

Through the feeding operation, the recording medium contacts a nip portion of registration rollers 15*a* and 15*b*. With this, the recording medium is conveyed at an appropriate timing into a transfer region between the photosensitive drum 18 and a transfer roller 17.

In the transfer region of the photosensitive drum 18, the transfer roller 17 is arranged in contact with a surface of the photosensitive drum 18. A transfer bias is applied to the transfer roller 17, and the transfer bias causes the toner image formed on the photosensitive drum 18 to be electrostatically transferred onto the recording medium.

Furthermore, the recording medium carrying the unfixed toner is conveyed toward a fixing device 19. In the fixing device 19, a fixing film 19*a* configured to apply heat to the recording medium is annularly arranged, and a pressure roller 19*b* is arranged so as to face and pressurize the fixing film 19*a*. A nip portion of the fixing film 19*a* and the pressure roller 19*b* causes a fixing operation due to a pressing and heating action. With this, the unfixed toner on the recording medium is fused so that the toner image is fixed onto the recording medium.

Furthermore, the recording medium onto which the toner image is fixed is delivered onto a delivery tray 23 by a delivery roller 21.

(Configuration of Developing Apparatus)

Figure 2:
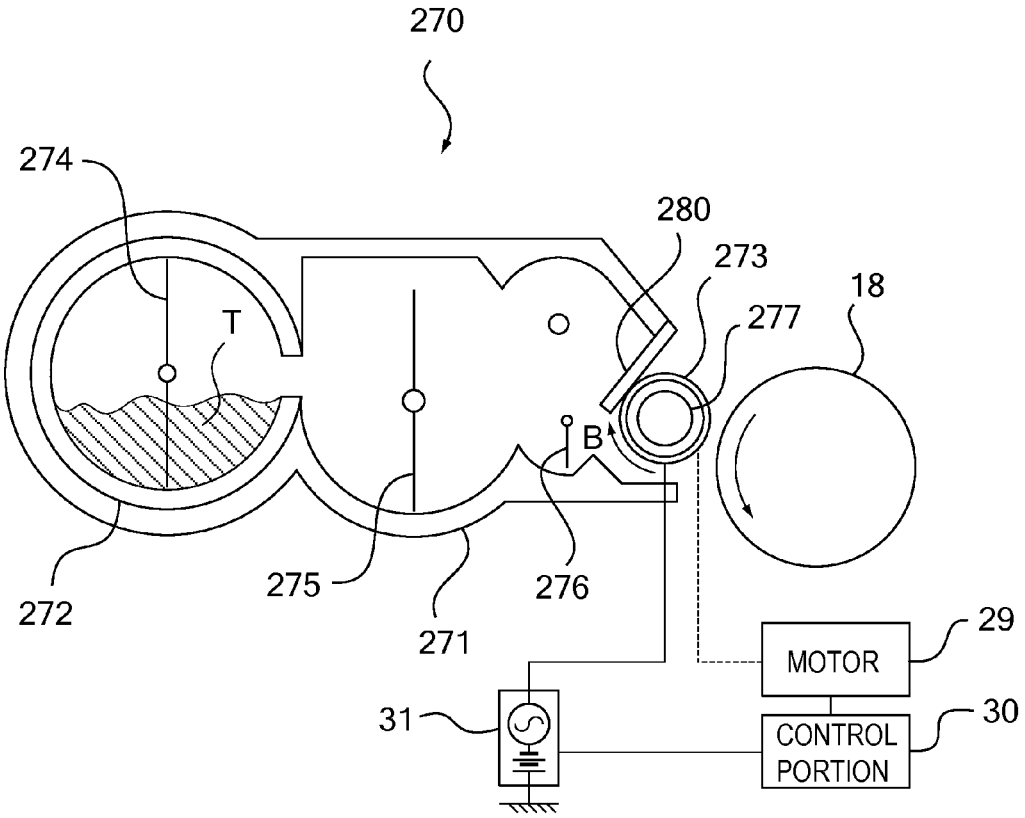
FIG. 2 is a schematic view of a configuration of a developing apparatus according to the embodiment of the present invention.

Next, a configuration of the developing apparatus 270 will be described. FIG. 2 is a schematic view of the configuration of the developing apparatus 270.

As illustrated in FIG. 2, the developing apparatus 270 includes a developing container 271 configured to contain developer. A cylindrical toner bottle 272 containing the developer is detachably mounted to the developing container 271. In order to replenish toner T (developer), the toner bottle 272 is mounted to the developing apparatus 270.

Meanwhile, a developing sleeve (developer carrying member) 273 configured to carry the toner T on its outer peripheral surface is arranged in a rotatable manner at a part of the developing container 271 facing the photosensitive drum 18. The toner T contained in the toner bottle 272 is conveyed up to the developing sleeve 273 by being moved in the developing container 271 due to a rotational driving action of stirring members 274, 275, and 276.

The developing sleeve 273 is a hollow cylindrical member made of a magnetic material, and includes a magnet roller 277 formed of a roller-shaped permanent magnet having a plurality of magnetic poles. The developing sleeve 273 is driven to rotate in a direction indicated by the arrow B by a motor 29 controlled by a control portion 30. Then, a magnetic field generated by the magnet roller 277 causes the toner T to be attracted and adhere onto the outer peripheral surface of the developing sleeve 273.

In a developing region (developing portion) in which the developing sleeve 273 and the photosensitive drum 18 face each other, the magnet roller 277 provided in the developing sleeve 273 generates the magnetic field. Furthermore, an electric field is generated by a developing bias voltage applied from a developing-bias power source 31 to the developing sleeve 273. By the action of the electromagnetic field, particles of the toner T applied to the outer peripheral surface of the developing sleeve 273 in a thin layer are caused to fly toward the photosensitive drum 18. Then, the particles of the toner T are caused to adhere to the electrostatic latent image formed on the surface of the photosensitive drum 18 so that development is performed. In this way, the electrostatic latent image is visualized as a toner image.

Specifically, the toner T contained in the developing container 271 is triboelectrically charged and carried onto the surface of the developing sleeve 273 while the developing bias voltage is applied to the developing sleeve 273. In this way, the toner T is supplied to the electrostatic latent image on the surface of the photosensitive drum 18 so that the development is performed.

At the time when the electrostatic latent image on the surface of the photosensitive drum 18 is developed by the developing apparatus 270, the developing bias voltage in which a direct current bias component is superimposed on an alternating current bias component is applied from the developing-bias power source 31 controlled by the control portion 30 to the developing sleeve 273. Then, by a difference between an electric potential of the developing sleeve 273 and an electric potential of the photosensitive drum 18, which is caused by the developing bias voltage applied from the developing-bias power source to the developing sleeve 273, a development electric field is generated between the developing sleeve 273 and the photosensitive drum 18. The development electric field causes the electrostatic latent image on the photosensitive drum 18 to be developed with the developer from the developing sleeve 273.

As illustrated in FIG. 2, the developing container 271 includes a developing blade unit (developer amount regulating unit) 280 configured to regulate a layer thickness of the developer (execute a predetermined process). In addition, an abdominal surface (side surface) part corresponding to a halfway part between a proximal portion and a distal end portion of the developing blade unit 280 is arranged in contact with the outer peripheral surface of the developing sleeve 273.

(Configuration of Developing Blade Unit)

Next, the developing blade unit 280 will be described.

Figure 3A:
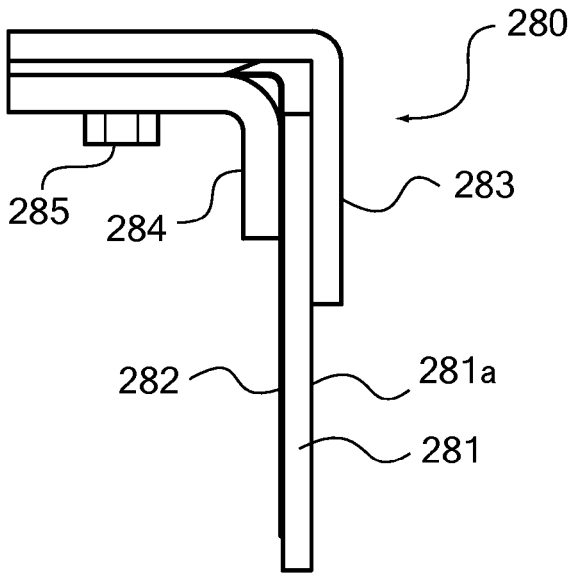
FIG. 3A is a side view of a configuration of a developing blade unit of the embodiment of the present invention in a case where a gap is not provided between a pressing member and a blade.
Figure 3B:
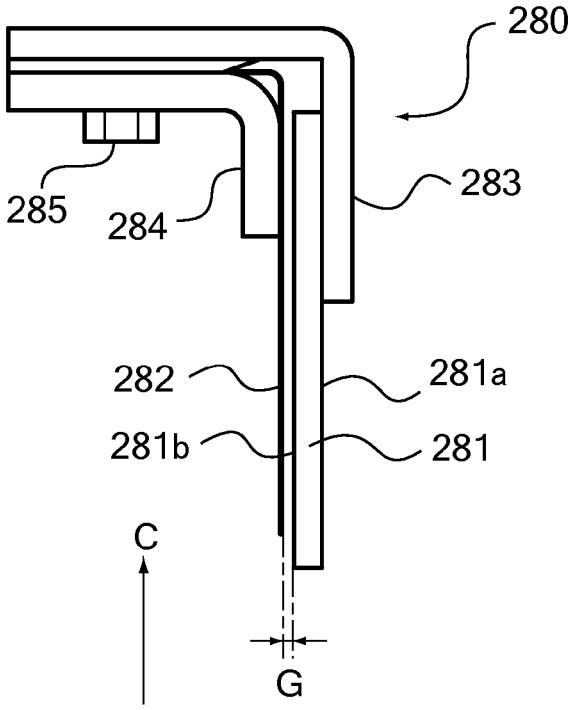
FIG. 3B is a side view of the configuration of the developing blade unit of the embodiment of the present invention in a case where a gap is provided between the pressing member and the blade.

FIGS. 3A and 3B are each a side view of the configuration of the developing blade unit 280. FIG. 3A illustrates a case where a gap is not provided between a pressing member (operation member) 282 and a developing blade (blade) 281, and FIG. 3B illustrates a case where a gap is provided between the pressing member 282 and the developing blade 281.

As illustrated in FIGS. 3A and 3B, the developing blade unit 280 includes the developing blade 281 formed of a plate-like elastic member made of, for example, an elastic rubber material. The pressing member 282 is provided on an opposite side of a contact surface 281*a* between the developing blade 281 and the developing sleeve 273 with respect to the developing blade 281. The pressing member 282 may be formed of a thin-plate-like elastically deformable or plastically deformable member. However, the pressing member 282 is not limited thereto, and may be formed of a rigid member. The developing blade 281 is fixed to a holding member (first holding member) 283. Furthermore, the pressing member 282 is fixed to an L-shaped adjusting member (second holding member) 284.

Furthermore, the adjusting member 284 and the holding member 283 are fastened (fixed) to each other with a screw (fixing member) 285, and are also fixed to the developing container 271 of the developing apparatus 270. An oblong hole 284*a* (FIG. 4) through which the screw 285 is inserted is provided in the adjusting member 284. With this, at the time of fastening the screw 285, a position of the adjusting member 284 can be adjusted. Adjustment of the position of the adjusting member 284 with respect to the holding member 283 enables adjustment between the state in which no gap is provided between the developing blade 281 and the pressing member 282 as illustrated in FIG. 3A and the state in which a gap (predetermined gap) G is provided between the developing blade 281 and the pressing member 282 as illustrated in FIG. 3B.

Figure 4:
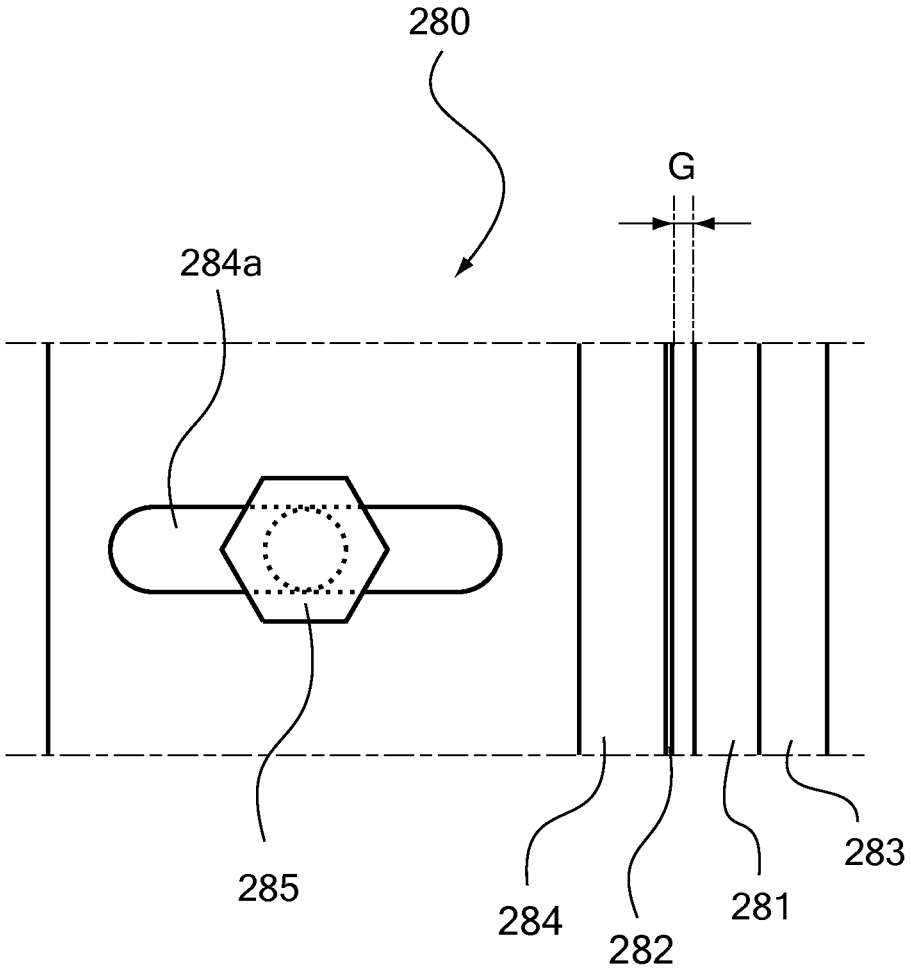
FIG. 4 is a part plan view of the developing blade unit of the embodiment of the present invention.

FIG. 4 is a part plan view of a vicinity of the screw 285 of the developing blade unit 280 as viewed in a direction indicated by the arrow C in FIG. 3B.

As illustrated in FIG. 4, the oblong hole 284*a* through which a threaded part of the screw 285 is inserted is provided in the adjusting member 284. With this, at the time of fastening the screw 285, the position of the adjusting member 284 can be adjusted with respect to the developing blade 281. Note that, as appropriate, a plurality of screws 285 may be provided in a longitudinal direction of the developing blade 281.

Note that, the adjusting member 284, the screw 285, the holding member 283, and the developing blade 281 constitute position adjusting means (a position adjusting unit).

Note that, in this embodiment, at the time of assembly of the developing blade unit 280, the gap G illustrated in FIG. 3B is set to 0.3 mm. The gap G is provided so as to correct the distortion of the developing blade 281 at the time when the developing blade 281 contacts the developing sleeve 273, and it is appropriate to set the gap G to 0.1 mm or larger.

Note that, after the assembly of the developing blade unit 280, the developing blade unit 280 is fixed to the developing container 271 of the image forming apparatus 100. The developing blade unit 280 may be adjusted so that the gap G is provided between the developing blade 281 and the pressing member 282 at the time of assembly of the developing blade unit 280 before the developing blade unit 280 is attached to the developing apparatus 270. In the developing blade unit 280, the gap G may be closed by deformation of the developing blade 281 contacting the developing sleeve 273 after the developing blade unit 280 is attached to the developing apparatus 270. Alternatively, in order to close the gap G, after the developing blade unit 280 is attached to the developing apparatus 270, the position of the adjusting member 284 may be adjusted so that the pressing member 282 is brought into contact with the developing blade 281 contacting the developing sleeve 273. The pressing member 282 may apply a pressing force (repulsive force) to the developing blade 281 contacting the pressing member 282.

Furthermore, the pressing force by the pressing member 282 can be adjusted by loosening the screw 285, moving the adjusting member 284, and then fastening again the screw 285 in a state in which the developing blade unit 280 is fixed to the developing container 271 and in which the developing blade 281 contacts the developing sleeve 273.

(Operation of Developing Blade Unit)

Next, an operation of the developing blade unit 280 will be described.

Figure 5:
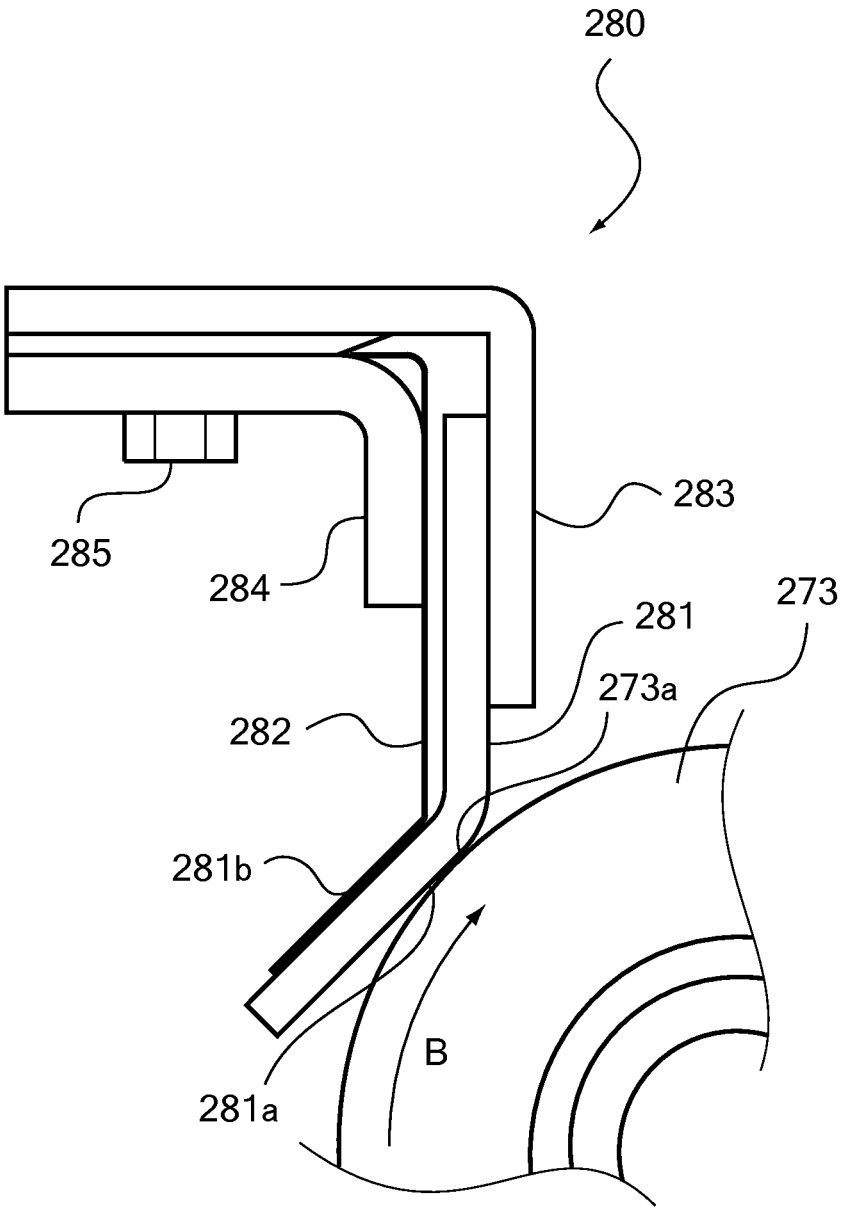
FIG. 5 is a view of a state in which the developing blade of the embodiment of the present invention contacts the developing sleeve.

FIG. 5 is a view of a state in which the developing blade 281 of the developing blade unit 280 contacts the developing sleeve 273.

As illustrated in FIG. 5, the contact surface (flat surface part) 281*a* of the developing blade 281 contacts in an abdominal contact with an outer peripheral surface 273*a* of the developing sleeve 273 in a counter direction reverse to the rotation direction B of the developing sleeve 273. At this time, after the developing blade 281 is deformed by coming into contact with the outer peripheral surface 273*a* of the developing sleeve 273, a back surface 281*b* of the developing blade 281 and the pressing member 282 are in contact with each other. The pressing member (operation member) 282 is configured to contact the developing blade 281, which is deformed, so as to cause the developing blade 281 to act on the developing sleeve 273 at a predetermined pressure.

Thus, the distortion of the developing blade 281 due to the developing blade 281 being an elastic member can be corrected along the developing sleeve 273 without influence of the pressing force exerted by the pressing member 282. After the distortion of the developing blade 281 is corrected in this way, the developing blade 281 is pressed by the pressing member 282. In this way, the developing blade 281 is pressed and rubbed against the developing sleeve 273 while influence of the distortion of the developing blade 281 is prevented as much as possible.

Then, on a downstream side in the rotation direction B with respect to a contact position of the developing blade 281, a state in which the toner T is applied to the outer peripheral surface 273*a* of the developing sleeve 273 in a thin layer having a uniform thickness is achieved.

Meanwhile, by an action of friction between the developing blade 281 and the toner T adhering to the outer peripheral surface 273*a* of the developing sleeve 273 which is driven to rotate, the particles of the toner T are charged to have a polarity opposite to that of the electrostatic latent image formed on the surface of the photosensitive drum 18.

The toner T that is applied to the outer peripheral surface 273*a* of the developing sleeve 273 in a thin layer by the developing blade 281 is conveyed, along with rotation of the developing sleeve 273, to the developing region in which the developing sleeve 273 and the photosensitive drum 18 face each other.

The developing blade 281 configured to contact the outer peripheral surface 273*a* of the developing sleeve 273 so as to regulate an amount of the toner T is made of, for example, urethane rubber having a JISA rubber hardness of 40 degrees. Furthermore, a contacting force P at the time when the developing blade 281 contacts the outer peripheral surface 273*a* of the developing sleeve 273 is set to, for example, approximately 30 gf/cm. In this case, the contacting force P is indicated in a contacting load (gf) per unit length (1 cm) in a longitudinal direction of the developing sleeve 273. A nip width between the developing sleeve 273 and the developing blade 281 is set to 1.0 mm.

Note that, the gap G can be adjusted by loosening the screw 285, moving the adjusting member 284, and then fastening again the screw 285 in the state in which the developing blade unit 280 is fixed to the developing container 271 and in which the developing blade 281 contacts the developing sleeve 273.

In this way, after the fixation of the developing blade unit 280, a contact pressure at the time when the developing blade 281 contacts the developing sleeve 273 can be adjusted by moving the adjusting member 284 without changing a positional relationship between the developing blade 281 and the developing sleeve 273. Thus, the contact pressure can be adjusted in a state in which the area size of a nip region between the developing blade 281 and the developing sleeve 273 stays the same. As a result, influence on images can be prevented.

Note that, in the embodiment described above, the present invention is applied to the developing blade 281 configured to regulate the layer thickness of the toner on the outer peripheral surface of the developing sleeve 273. However, the present invention is applicable also to a cleaning blade configured to clean the photosensitive drum 18. Thus, the above-mentioned developer carrying member conceptually includes the photosensitive drum. In that case, the developing apparatus may include the photosensitive drum and the cleaning blade.

In the embodiment, when the blade (developing blade or cleaning blade) is brought into contact with the developer carrying member (developing sleeve or photosensitive drum), the blade contacts the developer carrying member so as to be deformed, and after the deformation of the blade, the blade is brought into contact with the pressing member so that the pressing member presses the blade against the developer carrying member.

Thus, when the blade is brought into contact with the developer carrying member, the pressing member is first brought into contact with the blade so that the blade is deformed along the surface of the developer carrying member without generating friction between the blade and the pressing member. In this way, the distortion of the blade is corrected. Then, the blade is pressed against the developer carrying member by the pressing member.

Thus, even in a case where the blade has a distortion, the blade can be brought into contact with the developer carrying member at a uniform pressure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2013-251801, filed Dec. 5, 2013, and No. 2013-251802, filed Dec. 5, 2013 which are hereby incorporated by reference herein in their entirety.

What is claimed is:

1. A developing apparatus, comprising:

a developer carrying member configured to carry developer;

a blade configured to be deformed by contacting the developer carrying member; and an operation member provided on an opposite side to a side of the blade contacting the developer carrying member, the blade being configured to be deformed to the opposite side so as to contact the operation member from which the blade has been separated, so that the operation member presses the blade against the developer carrying member.

2. A developing apparatus according to claim 1, further comprising a position adjusting unit configured to adjust a predetermined gap between the blade and the operation member in a state in which the blade is out of contact with the developer carrying member.

3. A developing apparatus according to claim 2, wherein the position adjusting unit comprises:

a first holding member configured to hold the blade;

a second holding member configured to hold the operation member; and a fixing member configured to fix the first holding member and the second holding member, and wherein the position adjusting unit is configured to adjust a position of the operation member with respect to the blade by changing a position of the second holding member with respect to the first holding member to fix the first holding member and the second holding member by the fixing member.

4. A developing apparatus according to claim 1, wherein the developer carrying member comprises a developing sleeve configured to supply the developer to an image bearing member configured to bear a latent image, and wherein the blade rubs against the developing sleeve so as to regulate the developer on an outer peripheral surface of the developing sleeve.

5. A developing apparatus according to claim 4, further comprising:

a first holding member configured to hold the blade;

a second holding member configured to hold the operation member; and a fixing member configured to fix the first holding member and the second holding member, wherein the blade, the operation member, the first holding member, the second holding member, and the fixing member are assembled into a developer regulating unit configured to regulate the developer on the outer peripheral surface of the developing sleeve, and thereafter the developer regulating unit is fixed to a body of the developing apparatus.

6. A developing apparatus according to claim 5, further comprising a developing container configured to contain the developer to be supplied to the developing sleeve, wherein the developer regulating unit is fixed to the developing container.

7. A developing apparatus according to claim 1, wherein a predetermined gap between the blade and the operation member, in a state in which the blade is out of contact with the developer carrying member, is set to 0.1 mm or larger.

8. A developing apparatus according to claim 1, wherein the blade is made of urethane rubber.

9. An image forming apparatus, comprising:

an image forming portion configured to form an image on a recording medium; and a developing apparatus as recited in claim 1 and provided in the image forming portion.

* * * * *